US008770447B2

(12) United States Patent
Marshall

(10) Patent No.: US 8,770,447 B2
(45) Date of Patent: Jul. 8, 2014

(54) STERILE LUBRICANT DISPENSING APPARATUS

(76) Inventor: Janie Marshall, River Hills, WI (US)

( * ) Notice: Subject to any disclaimer, the term of this patent is extended or adjusted under 35 U.S.C. 154(b) by 0 days.

(21) Appl. No.: 13/457,426

(22) Filed: Apr. 26, 2012

(65) Prior Publication Data

US 2012/0273519 A1 Nov. 1, 2012

Related U.S. Application Data

(60) Provisional application No. 61/479,101, filed on Apr. 26, 2011.

(51) Int. Cl.
*B67D 7/60* (2010.01)

(52) U.S. Cl.
USPC ..... 222/388; 222/61; 222/108; 222/192; 222/380; 222/386

(58) Field of Classification Search
USPC ..... 222/61, 98, 192, 388, 101, 102, 325, 222/108, 52
See application file for complete search history.

(56) References Cited

U.S. PATENT DOCUMENTS

| | | | | |
|---|---|---|---|---|
| 1,477,459 | A * | 12/1923 | Skelly | 222/340 |
| 4,842,581 | A * | 6/1989 | Davis | 604/38 |
| 6,161,726 | A * | 12/2000 | Parsons et al. | 222/52 |
| 6,561,389 | B1 | 5/2003 | Earle | |
| 2004/0226962 | A1 * | 11/2004 | Mazursky et al. | 222/95 |
| 2005/0270755 | A1 | 12/2005 | Jansen | |

* cited by examiner

*Primary Examiner* — Paul R Durand
*Assistant Examiner* — Randall Gruby
(74) *Attorney, Agent, or Firm* — Absolute Technology Law Group, LLC

(57) ABSTRACT

A sterile lubricant dispenser for dispensing calibrated amount of a sterile lubricant having a viscosity greater than that of 150 P.

17 Claims, 10 Drawing Sheets

STERILE LUBRICANT DISPENSING APPARATUS

CLAIM OF PRIORITY

Cross Reference to Related Applications. This application claims priority to U.S. Provisional Application No. 61/479,101 filed on Apr. 26, 2011.

FIELD OF INVENTION

The present invention relates to the field of medical instruments, and specifically to medical instrument for dispensing a calibrated amount of sterile lubricant.

TERMINOLOGY

Figure 1:
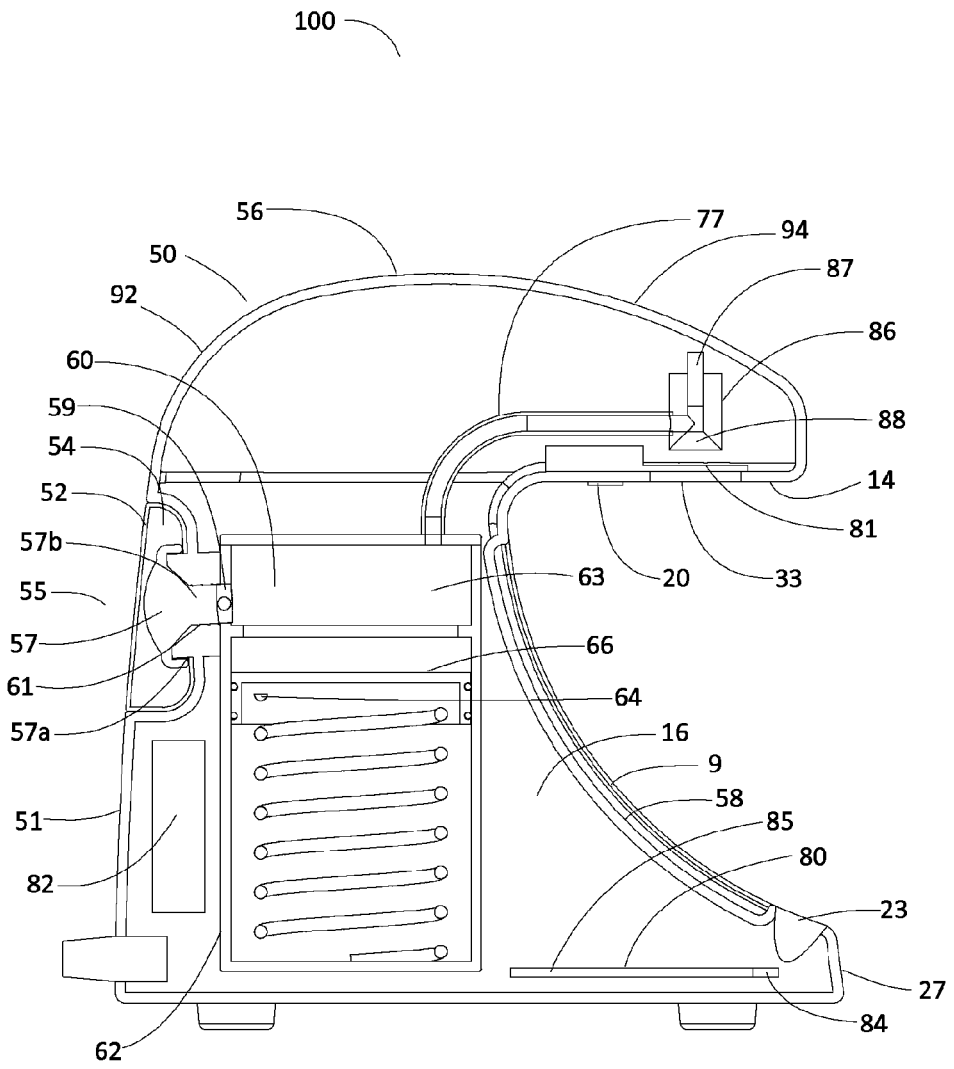
FIG. 1 illustrates a sectional view of an exemplary embodiment of a sterile lubricant dispenser system.

As used herein, the term "sanitary clearance" is physical space which prevents physical contact during activation of a sensor to provide sterile lubricant.

As used herein, the term "sanitary clearance distance" measured a distance X which represents the quantified length of a component necessary to provide clearance to a user's hand to avoid physical contact during activation of a sensor to provide sterile lubricant.

As used herein, the term "disproportionate clearance curvature" disproportionate arc with a curve radius that is larger at the top of the arc and decreases toward the bottom of the arc. Disproportionate clearance curvature is a critical shape which minimizes contact to provide sanitary clearance.

As used herein, the term "sterile lubricant" refers to any substance having a viscosity in excess of 150 P and as high 1000 P.

As used herein, the term "viscosity" means the measure of the resistance of a fluid to deformation by shear stress or tensile stress. Viscosity is a measurement of the thickness of a fluid or fluid-like substance and is measured in poise (P).

As used herein, the term "sterile lubricant container" means any flexible container which contains sterile lubricant which is expelled when the flexible container is squeezed or pressured. A sterile lubricant container may be tubular.

As used herein, the term "tubular" means rounded, oval or elliptical.

BACKGROUND

In the obstetrics and gynecology field, doctors and other medical professionals have to use lubricants while performing exams. Medical gel is a highly viscous substance. The viscosity gives it its lubricating properties.

Although the physicians (and other professionals) wear sterile gloves, they often handle lubricant tubes and the gloves may come in contact with the sterile lubricant container (e.g. a tube). Generally, to avoid the spread of disease by contact with the dispensing container, either the gloves must be changed or a second person, usually the medical assistant, assists with dispensing the lubricant from the tube.

Individual packets are also available. However, this can be very cumbersome. Alternatively, the physician who needs to dispense lubricant during an exam, must remove a glove, open the tube with a single hand, squeeze the lubricant out of the tube, reclose the tube, and put a glove back on the ungloved hand.

A physician may come in contact with numerous patients while using a tube or other lubricant dispensing containers, and may inadvertently contaminate the tube by touching it with gloved or ungloved hands. This creates the potential risk of transmitting diseases such as MRSA, Chlamydia, Gonorrhea, Group B Strep, or Bacterial Vaginosis to name a few.

Current automatic dispensers known in the art cannot be used with sterile lubricant due to its high viscosity.

Liquid hand soap has a viscosity of less than 150 P. In contrast, lubricant has a viscosity in excess of 150 P and as high 1000 P. The higher viscosity of the lubricant makes it impossible to pump through current automatic dispensers known in the art.

There is an unmet need for an apparatus or system that dispenses lubricant that has a viscosity in excess of 150 P and as high 1000 P There is a further unmet need to reduce the risk of contact with the sterile lubricant container and spread of disease.

SUMMARY OF THE INVENTION

The present invention is a dispensing system which allows lubricant to be sold and dispensed in the manufacture's container, but which limits contact with the physician's hands to maintain sterile conditions. It is designed to dispense sterile lubricant from the existing sterile lubricating container using the same the container and without allowing a physician or other user to touch any portion of the housing. A housing, which surrounds a reservoir, contains a sensor which acknowledges whether a hand is in the hand opening. The sensor activates a pump mechanism which dispenses a calibrated amount of sterile lubricant from a sterile lubricant dispensing aperture.

The present invention decreases potential for contamination when dispensing sterile lubricant during medical exams. The present invention also allows a calibrated amount of a sterile lubricant to be dispensed.

Various embodiments may include an adapter component to allow for any size sterile lubricant container. Various embodiments include the dispenser system being powered by a battery or an electrical adapter which an electrical cord may be inserted and plugged into the wall. Various embodiments may include a low voltage heating mechanism to gently heat the sterile lubricant prior to dispensing for the patient's comfort.

DETAILED DESCRIPTION OF INVENTION

For the purpose of promoting an understanding of the present invention, references are made in the text to exemplary embodiments of sterile lubricant dispensers, only some of which are described herein. It should be understood that no limitations on the scope of the invention are intended by describing these exemplary embodiments. One of ordinary skill in the art will readily appreciate that alternate but functionally equivalent structures and materials may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

It should be understood that the drawings are not necessarily to scale; instead emphasis has been placed upon illustrating the principles of the invention. In addition, in the embodiments depicted herein, like reference numerals in the various drawings refer to identical or near identical structural elements.

Moreover, the terms "substantially" or "approximately" as used herein may be applied to modify any quantitative representation that could permissibly vary without resulting in a change in the basic function to which it is related.

FIG. 1 illustrates an exemplary embodiment of a sterile lubricant dispenser system which is powered by a battery. In the exemplary embodiment shown, dispenser 100 is comprised of housing 50 which encloses a molded housing cavity 16. Housing 50 may be integrally formed or comprised of two or more interlocking housing components. As illustrated in FIG. 1, housing 50 is made of two components, but additional embodiments may include additional interlocking components to permit efficient manufacturing assembly using processes known in the art. Vertical rear portion 51 is an angled vertical surface. Upper housing portion 56 is a convexly curved surface section 92 and a sloped section 94. At upper housing portion's 56 peak, a line drawn tangentially will be parallel to lower flattened horizontal member 14. Upper housing portion 56 has a flattened vertical surface transition to lower flattened horizontal member 14. Contoured front portion 58 is a concavely contoured surface.

Housing 50 includes an upper housing portion 56 with lower flattened horizontal surface member 14 and a lower housing portion 27 with vertical rear portion 51 and contoured front portion 58. Contoured front portion 58 is contoured to avoid contact with a user's hand when dispensing a highly viscous sterile lubricant in a medical or other sterile environment. Contoured front portion 58 includes an exaggerated concave contour 9 which is contoured enough to eliminate any hand contact with sterile lubricant dispenser system 100.

Vertical rear portion 51 houses refill port assembly 55. Refill port assembly 55 includes non-sterile access door 52, which may be cleaned and sterilized, and encloses cavity 54 that accommodates refill port cap 57. Refill port cap 57 includes non-sterile outer surface 57*a* and sterile inner surface 57*b*, as well as threaded channel 61 which interfaces with one-way valve 59 which allows sterile lubricant to enter refill chamber assembly 60, but not to exit.

Refill chamber assembly 60 includes rounded outer chamber housing 62 encasing inner pressurized chamber cavity 63, inner spring 64 and spring loaded piston 66. Rounded outer chamber housing 62 is a tubular structure. It is critical that rounded outer chamber housing 62 be rounded in order to properly seal spring loaded piston 66 and create the pressured effect necessary to dispense a high viscosity substance.

Pressure is applied to sterile lubricant container 15 using compression tool 30 which causes sterile lubricant to flow through refill port assembly 55 to refill chamber assembly 60, thereby applying pressure to spring loaded piston 66 and forcing it downward as the sterile lubricant fills inner pressurized chamber cavity 63.

FIG. 1 further illustrates power supply assembly 80, which includes battery 82, charging circuit 85 for recharging, connector component 84, which interfaces with solenoid valve 86. Solenoid valve 86 forces the movement of magnetic solenoid pin 87 which opens dispensing orifice 88.

FIG. 1 also illustrates sealing aperture door 81 which closes sterile lubricant dispensing aperture 33. Sterile lubricant dispensing aperture 33 prevents sterile lubricant from drying in dispensing orifice 88.

Dispensing tube 77 conveys sterile lubricant from inner pressurized chamber cavity 63. Motion sensor 20 triggers operation of solenoid valve 86 and sealing aperture door 81. In the exemplary embodiment shown, motion sensor 20 is located on lower flattened horizontal surface member 14 behind sealing aperture door 81 and sterile lubricant dispensing aperture 33.

Figure 2:
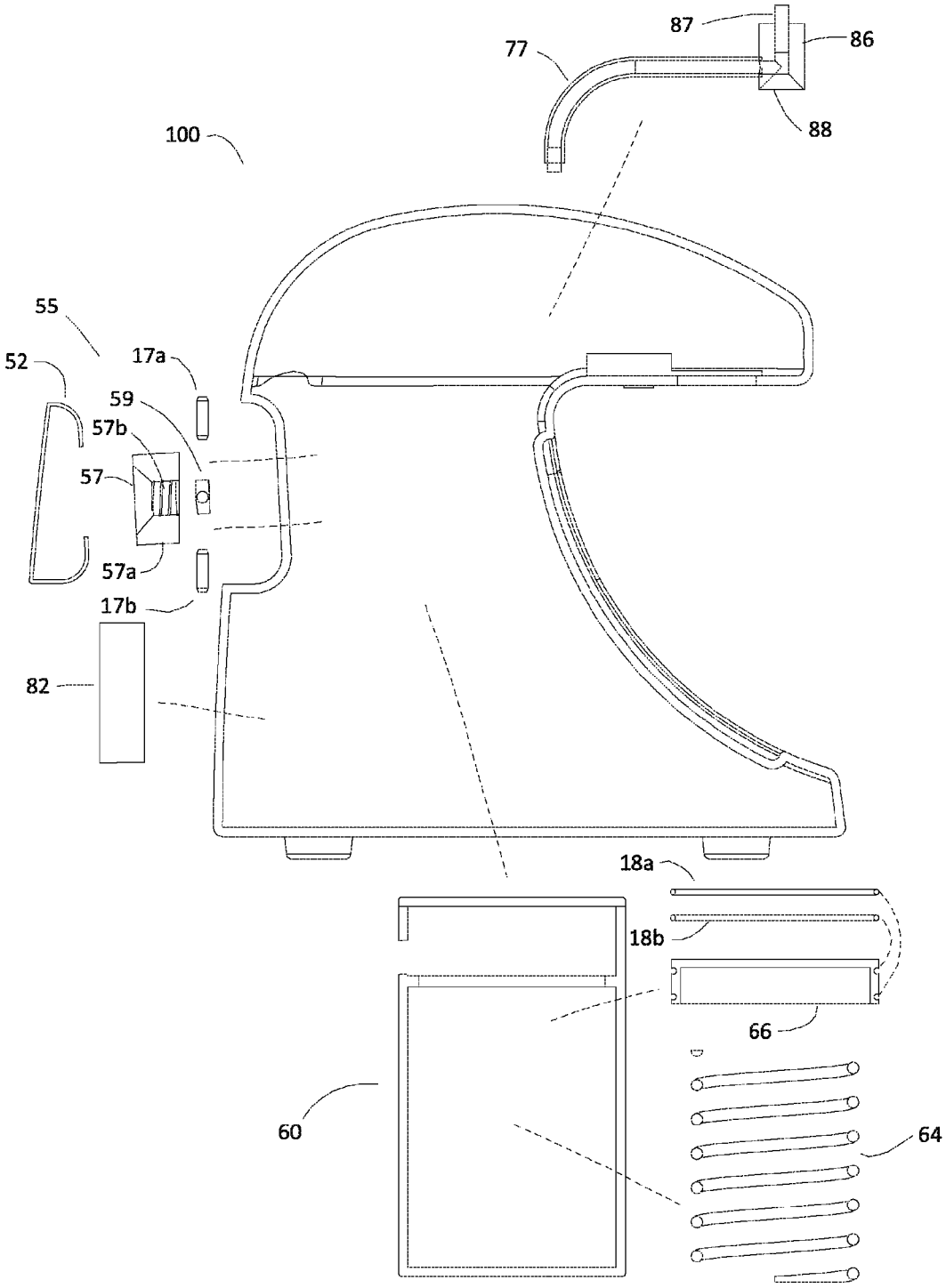
FIG. 2 illustrates an exploded view of an exemplary embodiment of a sterile lubricant dispenser system powered by a battery.

FIG. 2 illustrates an exploded view of an exemplary embodiment of a sterile lubricant dispenser system 100 which is powered by a battery 82.

Sterile lubricant dispenser system 100 contains refill port assembly 55, refill chamber assembly 60, battery 82, dispensing tube 77, magnetic solenoid pin 87, solenoid valve 86, and dispensing orifice 88.

As illustrated in FIG. 2, the components of refill port assembly 55, which include non-sterile access door 52, refill port cap 57, one-way valve 59, and pins 17*a*, 17*b*, are shown as separately manufactured components. Refill port cap 57 includes non-sterile outer surface 57*a*, sterile inner surface 57*b*, and threaded channel 61. Similarly, the components of refill chamber assembly 60, which include inner spring 64, spring loaded piston 66, and O-rings 18*a*, 18*b* are shown as separately manufactured components.

Figure 3:
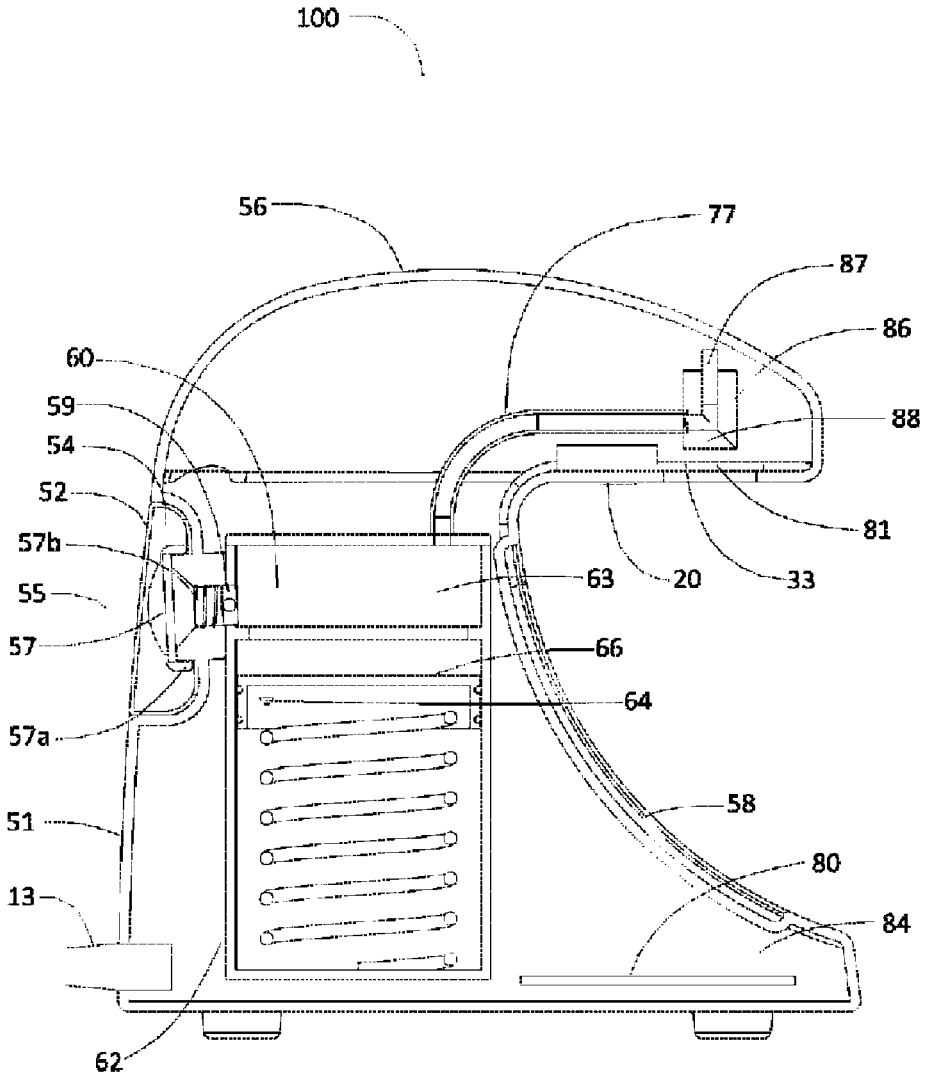
FIG. 3 illustrates an exemplary embodiment of a sterile lubricant dispenser system which includes an electrical adapter.

FIG. 3 illustrates an exemplary embodiment of a sterile lubricant dispenser system 100 which includes an electrical adapter 13. In the exemplary embodiment shown, electrical adapter 13 is positioned at the base of vertical rear portion 51. Electrical adapter 13 is configured to receive a power cord that is able to be plugged into the wall.

Figure 4B:
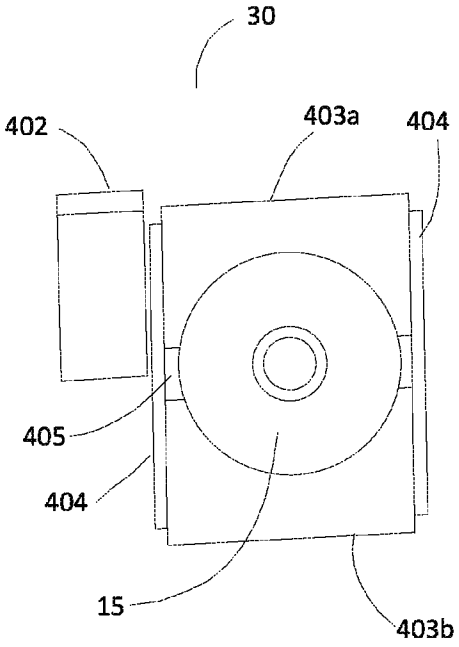
FIGS. 4*a* and 4*b* illustrate an exemplary embodiment of a tool for use with a sterile lubricant dispenser system.
Figure 4A:
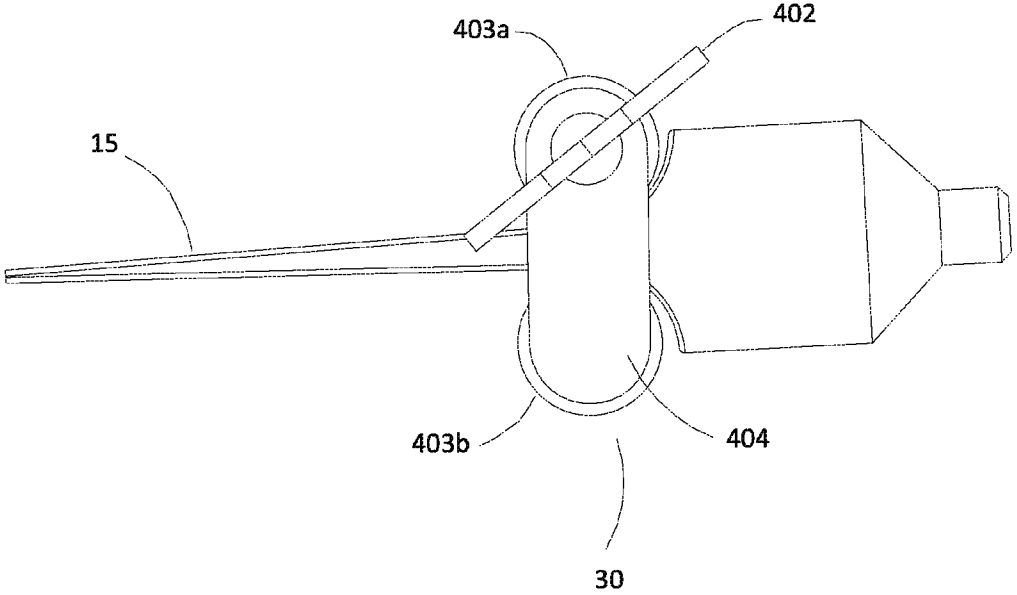

FIG. 4*a* illustrates a side view of an exemplary embodiment of a compression tool 30 for use with a sterile lubricant dispenser system 100. In the exemplary embodiment shown, compression tool 30 is comprised of rollers 403*a* and 403*b* which are attached to base 404 at an inner surface in order to create aperture 405 where sterile lubricant container 15 will be placed. Base 404 also includes rotatable lever 402 connected at an outer surface, preferably at the location of one of the rollers 403.

In the embodiment shown, sterile lubricant container 15 is placed in aperture 405 and rotatable lever 402 is rotated clockwise. This action rotates rollers 403*a* and 403*b* and pressure is applied to sterile lubricant container 15 which causes sterile lubricant to flow through refill port assembly 55.

FIG. 4*b* illustrates a front view of an exemplary embodiment of a compression tool 30 for use with a sterile lubricant dispenser system 100.

Figure 5:
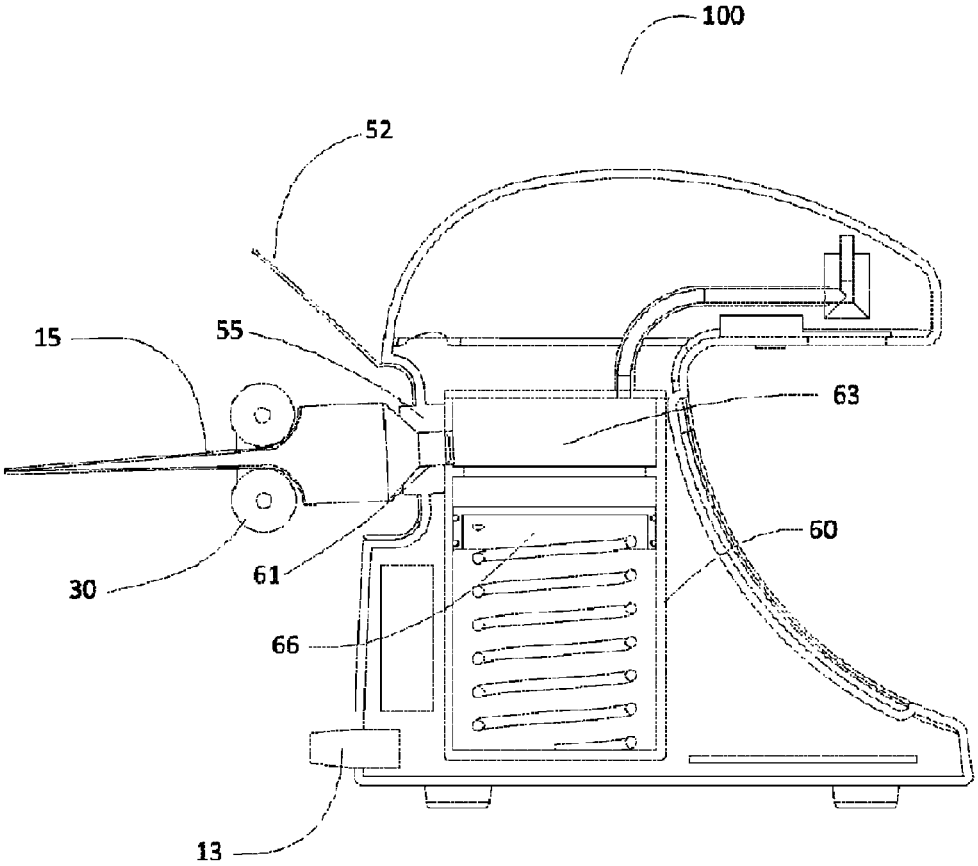
FIG. 5 illustrates an exemplary embodiment of a sterile lubricant dispenser system with a sterile lubricant container inserted.

FIG. 5 illustrates an exemplary embodiment of a sterile lubricant dispenser system 100 with a sterile lubricant container 15 inserted. Non-sterile access door 52 is removed or opened, refill port cap 57 is also removed and sterile lubricant container 15 is screwed into threaded channel 61 which interfaces with one way valve 59 which allows sterile lubricant to enter refill chamber assembly 60, but not exit.

Pressure is applied to sterile lubricant container 15 using compression tool 30 which causes sterile lubricant to flow through refill port assembly 55 and into refill chamber assembly 60, thereby applying pressure to spring loaded piston 66 and forcing it downward as the sterile lubricant fills inner pressurized chamber cavity 63.

Figure 6A:
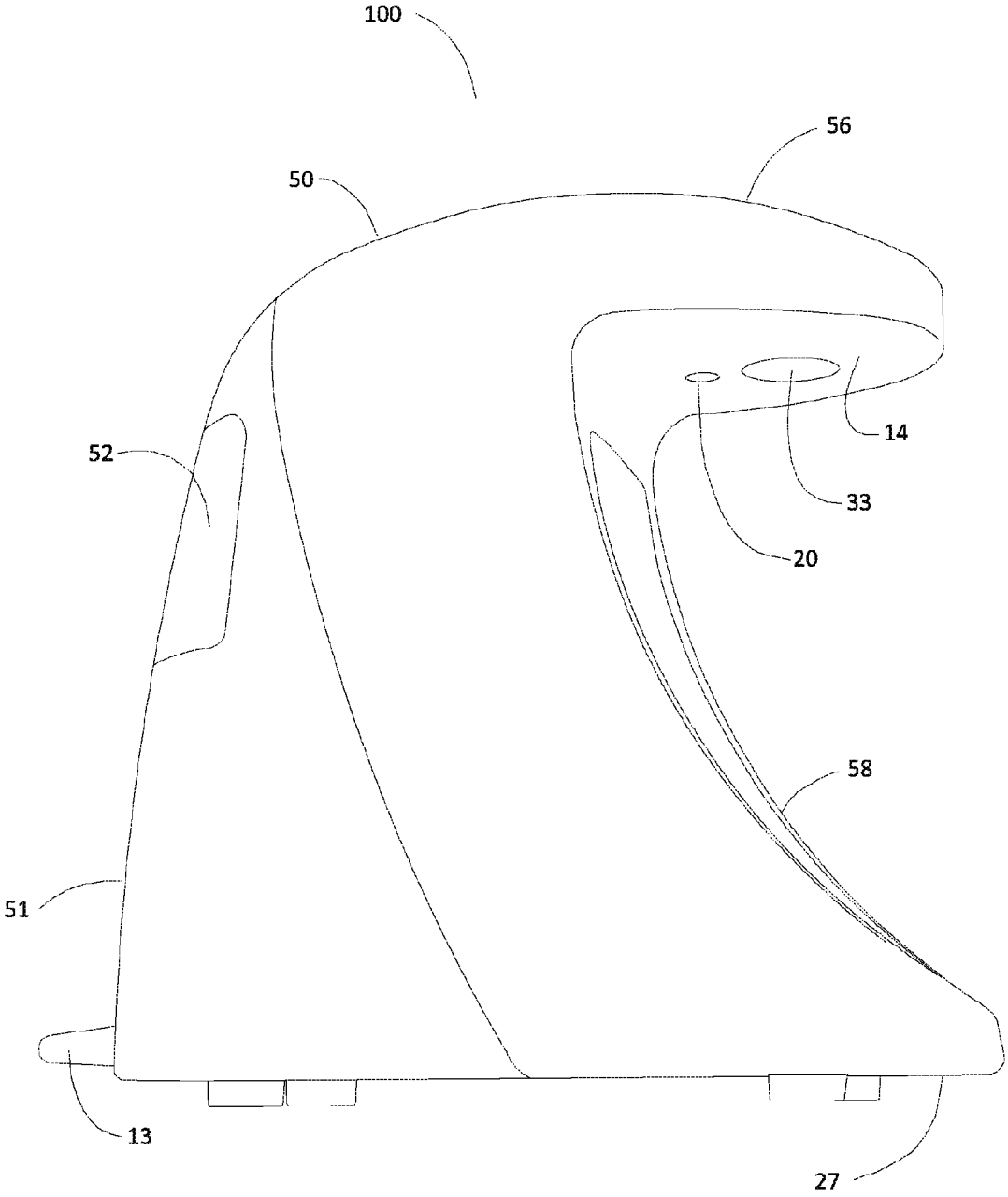
FIGS. 6*a*, 6*b* and 6*c* illustrate an exemplary housing for a sterile lubricant dispenser system.
Figure 6B:
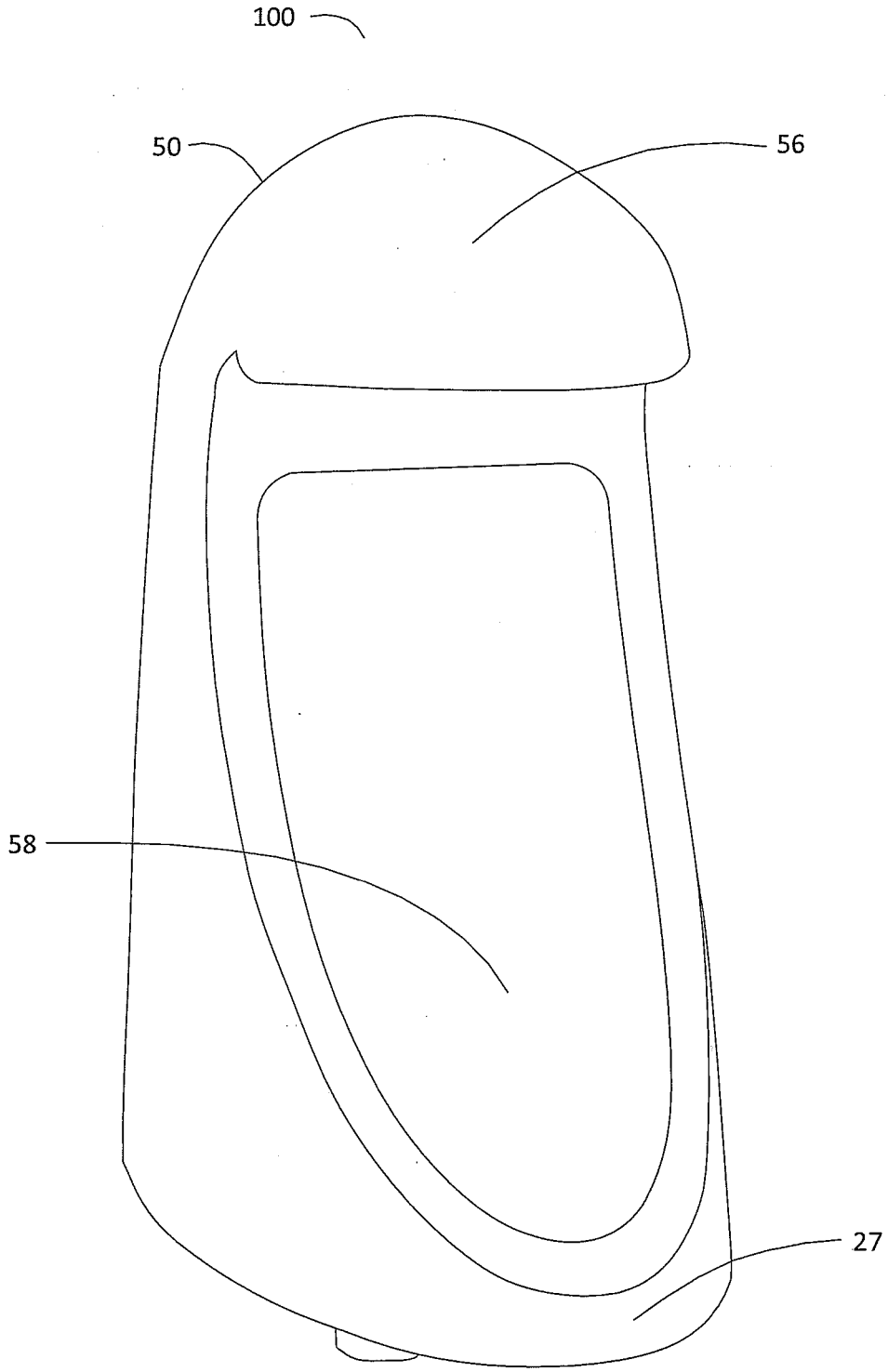
Figure 6C:
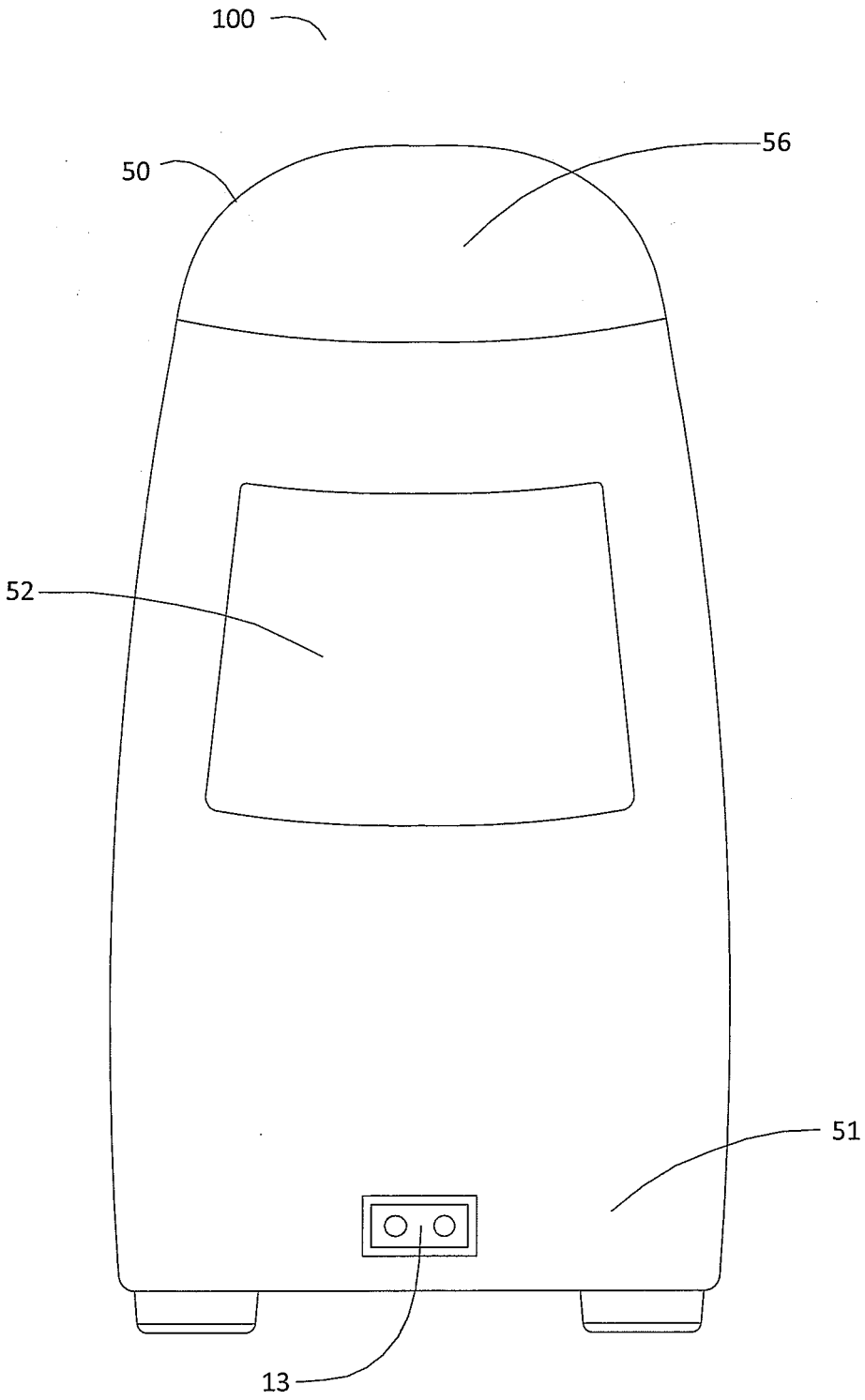

FIGS. 6*a*, 6*b*, and 6*c* illustrate exemplary embodiments of a housing 50 for a sterile lubricant dispenser system 100. FIG. 6*a* is a perspective side view of an exemplary embodiment of a housing 50 for a sterile lubricant dispenser system 100. In the exemplary embodiment shown, sterile lubricant dispenser system 100 is comprised of housing 50 which includes upper housing portion 56, vertical rear portion 51, and contoured front portion 58.

As shown in the exemplary embodiment in FIG. 6*a* housing 50, and contoured front portion 58, is configured to allow a hand to slide in between upper housing portion 56 and lower housing portion 27 while sterile lubricant dispenser system 100 is sitting on a horizontal surface. In further exemplary embodiments, housing 50 may be differently configured to allow a calibrated amount of sterile lubricant to dispense into a hand. For example, lower housing portion 27 may be smaller with no catch basin 23 so that there is no housing 50 below sterile lubricant dispensing aperture 33 which a hand may accidentally bump, causing contamination. In further exemplary embodiments, to prevent sterile lubricant dispenser system 100 from tipping or falling when bumped or operated, lower housing portion 27 may be weighted or contain stabilizing structures, such as feet, grips or any other structure or device known in the art to stabilize a housing on a horizontal surface.

In still further exemplary embodiments, the physical appearance of sterile lubricant dispenser system 100 may be extremely important. For example, when used in a medical environment, it is important that sterile lubricant dispenser system 100 have a clean, streamlined appearance. Specifically, when used in an OB/GYN practice, sterile lubricant dispenser system 100 will be present on exam room tables and should be of a shape and design pleasing to the environment (i.e., sterile lubricant dispenser system 100 should not be configured to resemble any part of human anatomy).

FIG. 6*b* is a perspective front view of an exemplary embodiment of a housing 50 for a sterile lubricant dispenser system 100. FIG. 6*c* is a rear view of an exemplary embodiment of a housing 50 for a sterile lubricant dispenser system 100.

Figure 7:
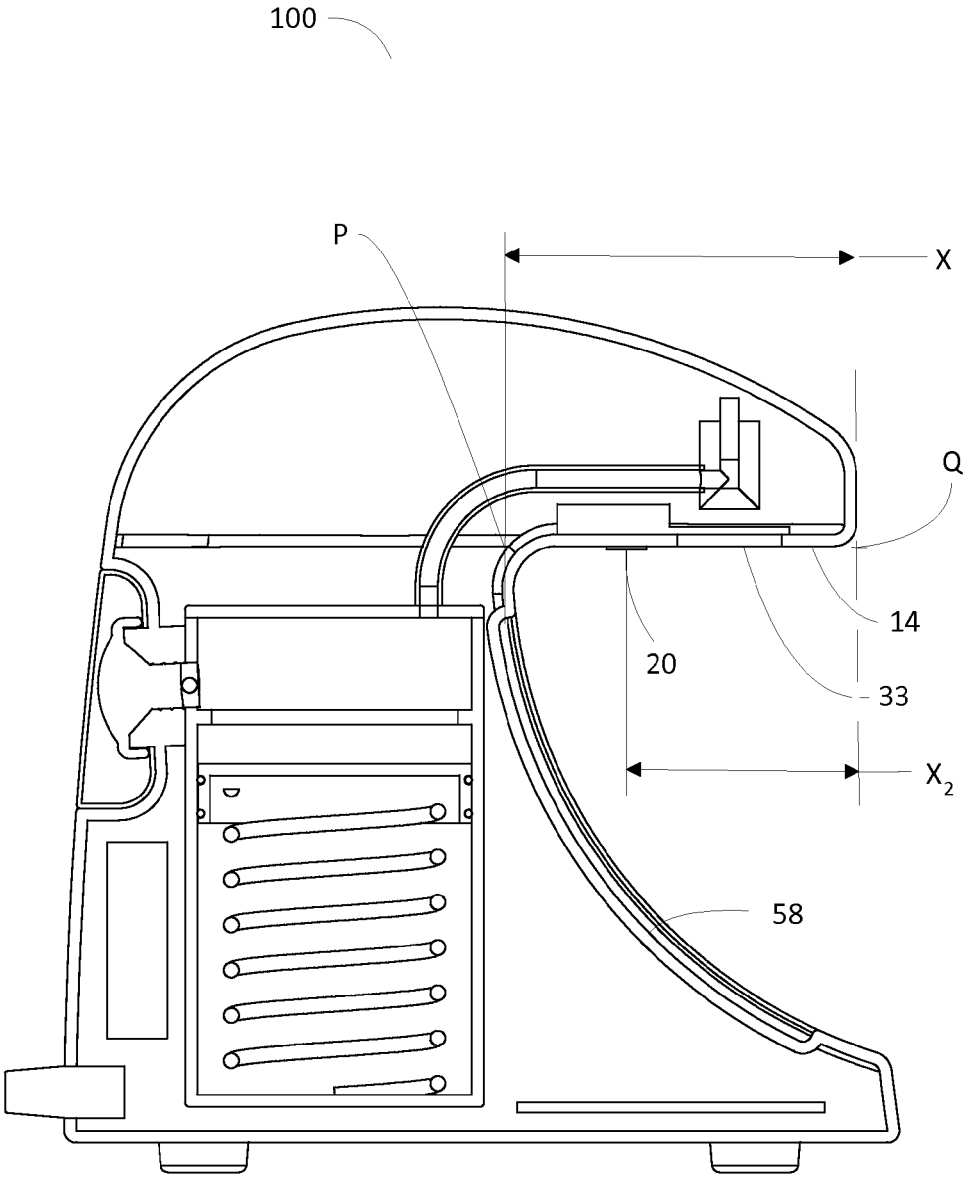
FIG. 7 illustrates an exemplary embodiment of a sterile lubricant dispenser system with a flattened horizontal surface member having a sanitary clearance distance.

FIG. 7 illustrates flattened horizontal surface member 14, having a sanitary clearance distance X, as measured from the outer point of housing Q to a point P which represents the endpoint of flattened horizontal surface member 14 and the beginning of contoured front portion 58. In order to prevent a user from touching any portion of housing 50 when dispensing sterile lubricant, X must be no less than the critical length of 210 mm, and which will accommodate the length and provide necessary clearance of a hand when the motion sensor 20 is activated.

FIG. 7 also illustrates distance $X_2$ which represents the distance between outer point of housing Q to the center point of motion sensor 20, and which is no greater than 25 to 35% the distance of X in the embodiment shown.

FIG. 7 also illustrates sanitary clearance curvature, showing disproportionately contoured front portion 58 that has a disproportionate arc with a curve radius that is larger at the top of the arc and decreases toward the bottom of the arc. Disproportionate clearance curvature is a critical shape which provides sanitary clearance.

Figure 8:
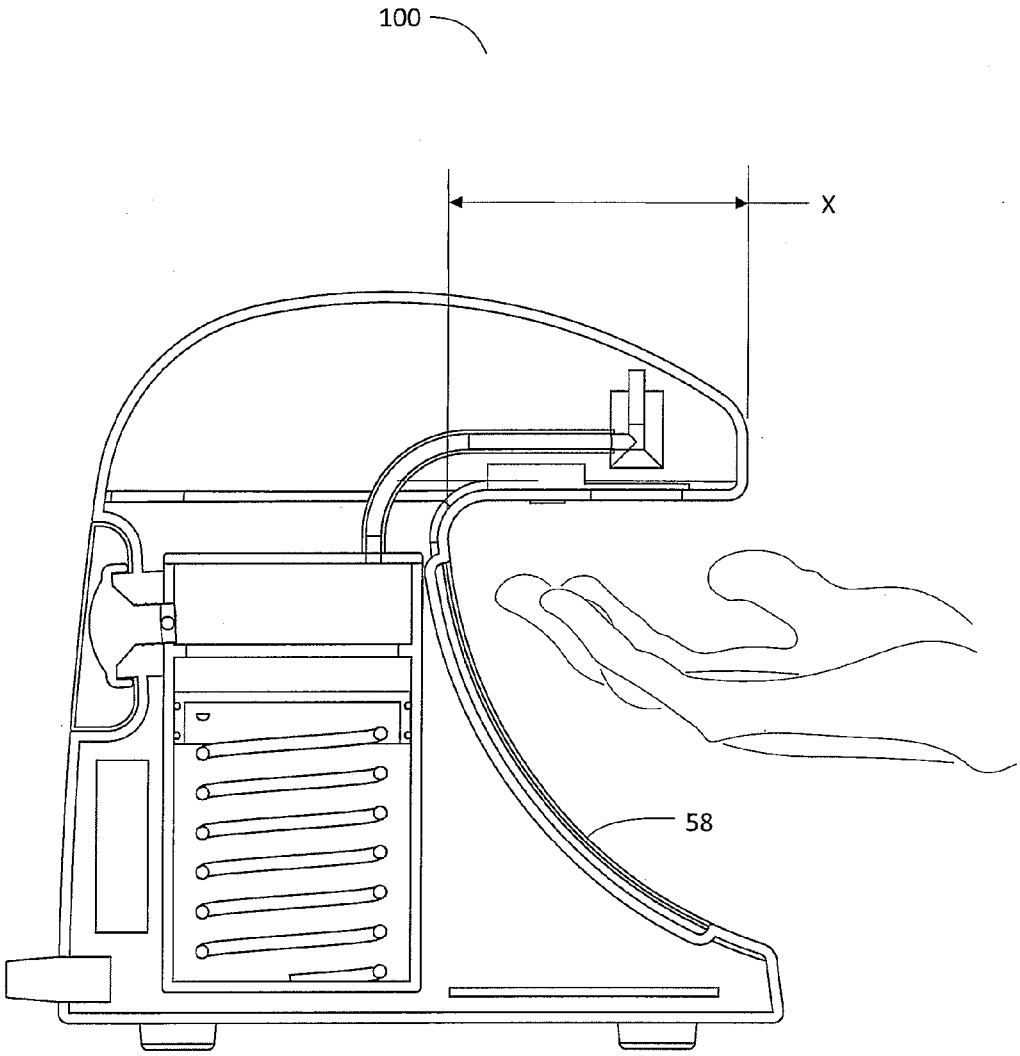
FIG. 8 illustrates an exemplary embodiment of a sterile lubricant dispenser system with a user's hand positioned relative to sanitary clearance distance and contoured front portion.

FIG. 8 illustrates a user's hand positioned relative to sanitary clearance distance X and contoured front portion 58.

What is claimed is:

1. A sterile lubricant dispensing system comprised of:

a sterile lubricant container containing a quantity of sterile lubricant, wherein said sterile lubricant container has a sterile threaded opening;

a compression tool assembly which provides pressure to said sterile lubricant container; and a dispenser to which said sterile threaded opening is selectively affixed, including:

a housing containing a sterile threaded channel, wherein said sterile threaded opening is centered within said compression tool assembly such that a longitudinal axis of said sterile lubricant container is on a plane perpendicular to said housing, said housing having an upper housing portion and a lower housing portion, wherein said upper housing portion includes an upper surface that includes a convexly curved section, a sloped section, and a lower flattened horizontal surface section located under the convexly curved and sloped sections, wherein said lower flattened horizontal surface section has a sanitary clearance distance having a value X, wherein said lower housing portion includes a contoured front portion having a sanitary clearance curvature, a base of said lower housing portion extends beyond said lower flattened horizontal surface section, and a height of said lower housing portion as measured between said lower flattened horizontal surface section and a base of lower housing portion is greater than a height of said upper housing portion as measured between said upper surface and said lower flattened horizontal surface section, a refill port assembly having a closed structure with sterile and non-sterile surfaces adapted to receive said sterile threaded opening of said sterile lubricant container, wherein said sterile threaded channel is located within said refill port assembly such that a portion of said refill port assembly is removable to permit reception of said sterile threaded opening within said sterile threaded channel, a refill chamber assembly with a rounded outer chamber housing which encases an inner pressurized chamber cavity, an inner spring, a spring loaded piston, and at least one O-ring, a motion sensor which triggers operation of a magnetic solenoid pin, wherein a center point of said motion sensor is located a distance having a value no greater than 35 percent of X as measured from an outer point (Q) of said lower flattened horizontal surface section, a solenoid valve which activates the opening of a dispensing orifice, a dispensing tube.

2. The sterile lubricant dispensing system of claim 1, wherein said refill port assembly further includes a non-sterile access door.

3. The sterile lubricant dispensing system of claim 2 wherein said non-sterile access door encloses a cavity that accommodates said refill port cap.

4. The sterile lubricant dispensing system of claim 3 wherein said refill port cap includes a non-sterile outer surface, a sterile inner surface, and said sterile threaded channel that interfaces with a one way valve.

5. The sterile lubricant dispensing system of claim 1 wherein said dispenser further includes a sealing aperture door.

6. The sterile lubricant dispensing system of claim 5 wherein said sealing aperture door closes a sterile lubricant aperture.

7. The sterile lubricant dispensing system of claim 1 wherein said compression tool includes a rotatable lever attached to at least one base.

8. The sterile lubricant dispensing system of claim 7 wherein said compression tool further comprises at least one roller attached to said at least one base.

9. The sterile lubricant dispensing system of claim 1 wherein said dispenser further includes a power assembly.

10. The sterile lubricant dispensing system of claim 9 wherein said power supply assembly includes a battery, a charging circuit for recharging, and a connector component which interfaces with said solenoid valve.

11. The sterile lubricant dispensing system of claim 1 wherein said dispenser further includes an electrical adapter positioned at a base of said vertical rear portion.

12. The sterile lubricant dispensing system of claim 1 wherein said sterile lubricant container is tube-shaped.

13. The sterile lubricant dispensing system of claim 1 wherein said dispenser further includes at least one grip attached to said lower portion.

14. The sterile lubricant dispensing system of claim 1 wherein said dispenser further includes a catch basin positioned in said lower portion.

15. The sterile lubricant dispensing system of claim 1 wherein said dispenser further includes an exaggerated concave contour positioned in said contoured front portion.

16. The sterile lubricant dispensing system of claim 1 wherein a distance from a center of said sterile lubricant dispensing aperture and a tangency point of said lower horizontal surface member is no less than 100 mm.

17. The sterile lubricant dispensing system of claim 16 wherein the radius of the curve of said contoured front is less at that lower points of contoured front portion than higher points.

* * * * *